US006692549B2

(12) United States Patent
Ha et al.

(10) Patent No.: US 6,692,549 B2
(45) Date of Patent: Feb. 17, 2004

(54) METHODS FOR INTEGRATION OF A BLAST FURNACE AND AN AIR SEPARATION UNIT

(75) Inventors: Bao Ha, San Ramon, CA (US); Jean-Renaud Brugerolle, Paris (FR)

(73) Assignee: Air Liquide Process and Construction, Inc., Houston, TX (US)

( * ) Notice: Subject to any disclaimer, the term of this patent is extended or adjusted under 35 U.S.C. 154(b) by 0 days.

(21) Appl. No.: 10/027,482

(22) Filed: Dec. 19, 2001

(65) Prior Publication Data

US 2003/0000342 A1 Jan. 2, 2003

Related U.S. Application Data

(60) Provisional application No. 60/301,574, filed on Jun. 28, 2001.

(51) Int. Cl.[7] ..... C21B 5/00
(52) U.S. Cl. ..... 75/466; 75/958
(58) Field of Search ..... 75/466, 958

(56) References Cited

U.S. PATENT DOCUMENTS 3,304,074 A * 2/1967 Atherton ..... 266/141
6,508,053 B1 * 1/2003 Ha et al. ..... 60/39.12

* cited by examiner

*Primary Examiner*—Melvyn Andrews
(74) *Attorney, Agent, or Firm*—Linda K. Russell

(57) ABSTRACT

The present invention generally relates to processes and apparatuses for the integration of a blast furnace and an air separation plant to increase blast furnace production. The present invention recovers energy from the air separation through the expansion of a product stream.

12 Claims, 3 Drawing Sheets

METHODS FOR INTEGRATION OF A BLAST FURNACE AND AN AIR SEPARATION UNIT

RELATED APPLICATION

The application claims priority from provisional application No. 60/301,574 filed on Jun. 28, 2001.

FIELD OF INVENTION

Embodiments of the present invention generally relate to processes and apparatuses for the integration of a blast furnace and an air separation unit to increase production of the blast furnace.

BACKGROUND OF THE INVENTION

For purposes of this patent, the following terms are defined. As used herein, the term "air separating unit" or "air separation unit" means and refers to a facility, plant, location or process for separating the components of air and may include both cryogenic and non-cryogenic facilities. As used herein, the terms "enhance," "enhanced," and/or "enhancing," means and refers to an act of altering and/or changing. As used herein, the term "oxygen supply" means and refers to an oxygen supply with a determinable oxygen content and is not limited nor excluded from a pure supply, but rather, may be any concentration of oxygen and/or oxygen content. As used herein, the term "oxygen rich" and "oxygen rich stream" means and refers to a gas or gases having an oxygen content greater than about 21.0% by volume. As used herein, the term "blast furnace air" or "blast furnace feed gas" means and refers to feed to a blast furnace to enable reduction of ores, blast furnace feed gas is not limited to one feed supply and may, in some cases, incorporate several sources of feed. As used herein, the term "nitrogen rich" and "nitrogen rich stream" means and refers to a gas or gases having an nitrogen content greater than about 80% by volume.

As well, the use of a particular structure, structures, or embodiments is not meant to be limiting. For instance, the term "apparatus" or "apparatuses" means and includes production facilities, plants, and the like. Further, the term "process" or "processes" means and includes "methods," "plans," "production plans," and the like. The term "led out," "fed," "feeding," and "feed" means and refers to allowing out, passing out, discharging, releasing, and/or the like.

Air separation plants are common in the art. Typical air separation units comprise at least one column in which components of air are separated into an oxygen rich liquid and a nitrogen rich gas. Feed gas, such as air, rising in the column is brought into gas-liquid contact in a countercurrent state with a reflux liquid flowing down from above. As a result, the downward liquid flow is gradually enriched in components whose boiling points are higher than that of nitrogen to become an oxygen rich liquid. In the same manner, upward rising vapor is gradually enriched in nitrogen to become a nitrogen rich gas. The degree of separation can be controlled by numerous factors, such as, but not limited to, the number of trays, height of column, number of columns, point of extraction of product, conditions of separation, and the like.

Blast furnaces are common in the art and primarily used for extraction of metals from ores, or the removal of oxygen from a metal oxide to produce the metal. A process of this type is commonly referred to as smelting. There are many different structures and types of blast furnaces available for smelting and each one may differ for its particular use or particular metal to produce.

There are many methods of operation of a blast furnace. Typical methods of operation of a blast furnace entail loading the blast furnace with a charge. The charge typically, but not in all cases, includes a quantity of ore, coke and a flux such as limestone. The charge is loaded into an upper portion of the blast furnace. At the same time, a gas, usually air, is introduced into the blast furnace. Oxygen is necessary in the feed gas for proper functioning of the blast furnace. The oxygen allows, as the feed gas passes through the charge, for a portion of the charge to be oxidized to carbon dioxide or carbon monoxide. The carbon monoxide then reduces the ore and reverts to carbon dioxide.

The use of oxygen rich gas, such as air, in a blast furnace is desirable for at least the following reasons: (1) with the use of an oxygen enrichment it is possible to switch to powdered charcoal and/or other fuels and to reduce coke consumption in the blast furnace and (2) with the use of an oxygen enrichment, production of the blast furnace may be increased. Accordingly, as the prior art has illustrated, various attempts have been made to facilitate the use of oxygen enrichment. A prior art example of a modification to a blast furnace is described in U.S. Pat. No. 5,244,489. In this patent, an oxygen plant equipped with a mixing column can efficiently treat a portion of blast furnace air to produce oxygen, which is injected into the blast air stream to yield the enriched feed gas. This allows for reducing the mass flow of oxygen-contained gas sent to the furnaces for the reduction of iron ore. More air can therefore be added to the furnace to increase the output of the steel production without increasing the system pressure drop.

Other prior art integrations are disclosed in U.S. Pat. Nos. 5,268,019 and 5,295,351. These patents describe various possible configurations for integrating an air separation unit with a gas turbine operated with low-BTU gas produced by a blast furnace. Air is extracted from the gas turbine to feed the air separation process. Low-BTU gas is compressed and heat exchanged with the extracted air before feeding the combustion chamber of the gas turbine. In a variant, the fuel is saturated with moisture prior to the expansion step to further increase turbine output.

Another similar patent is U.S. Pat. No. 5,317,862. This patent describes a similar configuration as U.S. Pat. Nos. 5,268,019 and 5,295,351. However, in this patent, the nitrogen stream from the air separation unit is heated, saturated with moisture and expanded to recover energy.

Other examples exist in the prior art for the treatment of a blast furnace, but do not combine various beneficial synergies of an air separation unit and a blast furnace. For example, another prior art example is found in U.S. Pat. No. 5,582,036. This patent describes the possibility of using a double-re-boiler type oxygen plant for blast furnace operation. Another prior art patent is U.S. Pat. No. 6,045,602. This patent describes the integration of the air separation unit and the subsequent gas treatment system to produce hydrogen gas to be used in the direct reduction of iron ore.

These prior art examples are beneficial, however, further advantages may be realized. For example, it would be advantageous for steel making companies to be able to increase production of a blast furnace without having to invest in new and/or high cost facilities. Additionally, it would be advantageous to efficiently utilize a blast furnace to maximize a return on investment and/or a more complete utilization of a process gas. As well, it would be advantageous to incorporate at least a portion of the aforementioned improvements while not appreciably increasing a cost of operating a blast furnace. Accordingly, the art field is in search of methods and apparatuses that may achieve at least a portion of these benefits.

SUMMARY OF THE INVENTION

Generally processes and apparatuses of the present invention relate to the integration of an air separation unit and a blast furnace. In embodiments of the present invention, at least a portion of a blast furnace feed gas may be removed and separated in an air separation unit, whereby an oxygen rich stream produced from the air separation unit may be fed to the blast furnace feed gas to enrich the oxygen content of the feed gas to the blast furnace, thereby increasing production of the blast furnace. Additionally, a second stream removed from the air separation unit may be expanded for recovery of energy. Further embodiments utilize a portion of the blast furnace off gas for the recovery of power.

This summary is not intended to be a limitation with respect to the features of the invention as claimed and any examples are merely intended as embodiments, and the scope and other objects can be more readily observed and understood in the detailed description and the claims that follow.

While the present invention will be described in connection with presently preferred embodiments, it will be understood that it is not intended to limit the invention to those embodiments. On the contrary, it is intended to cover all alternatives, modifications, and equivalents included within the spirit of the invention.

DETAILED DESCRIPTION OF THE INVENTION

Generally, embodiments of the present invention integrate an air separation unit and a blast furnace. In various embodiments of the present invention, combinations of an air separation unit and a blast furnace allow for increased production from the blast furnace and energy recovery.

Various air separating units for accomplishing separation of feed air exist in the prior art and are well known. Generally, in air separating units, feed gas, such as air, is first decarbonated, dried, cooled, and compressed by a compressor or other processes well known in the art. The decarbonating, drying, and cooling of a gas in an air separation unit is performed by equipment such as, but not limited to adsorber unit(s), absorber unit(s), molecular sieve (s), decarbonating-drying apparatuses, and/or the like. The feed gas is then rectified for separation in a rectification column to allow separation of the components of air. In the separation of air, various examples of product gases include a nitrogen-rich gas or liquid, a liquid rich in oxygen (also sometimes called liquid rich or oxygen rich) at the bottom of the column, as well as other constituents of air. For example, the air separation unit as described in U.S. Pat. No. 4,717,410 may be used in various embodiments of the present invention, and is incorporated herein by reference.

Likewise, blast furnaces are common in the art, as is illustrated in U.S. Pat. No. 5,244,489, incorporated herein by reference. The present invention is not intended to be limited to any particular type of blast furnace.

Figure 1:
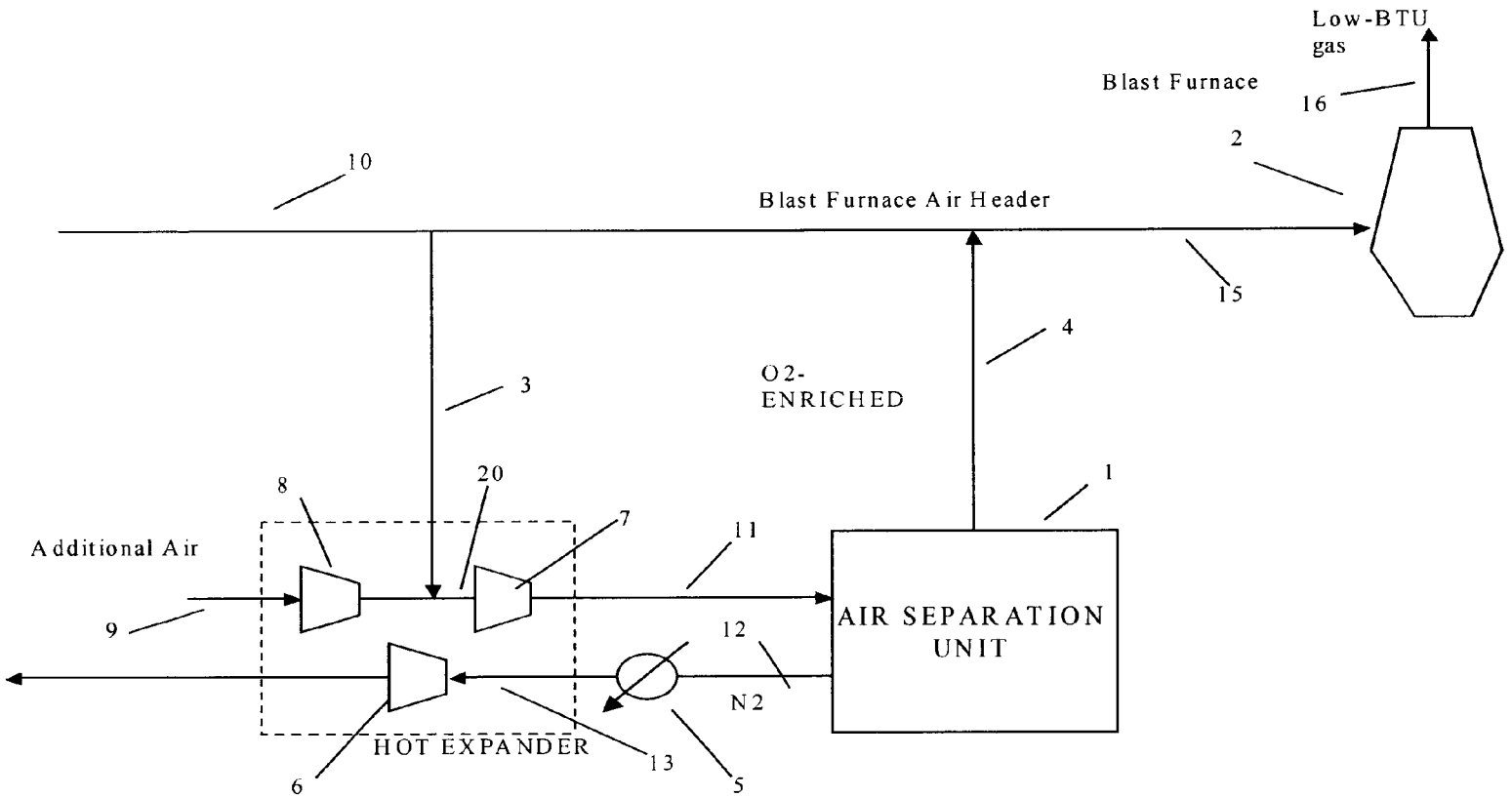
FIG. 1 is an illustration of an embodiment of an integrated air separation unit with a blast furnace.

An illustration of an embodiment of an integrated air separation unit with a blast furnace is shown in FIG. 1. Generally, the present invention is composed of an air separation unit 1 and a blast furnace 2. Blast furnace feed air stream 10 is fed to blast furnace 2. A portion of feed air stream 10 is diverted and/or removed as stream 3.

Stream 3 is then separated into at least an oxygen rich product in air separation unit 1. In the embodiment illustrated in FIG. 1, stream 3 is compressed in compressor 7 prior to air separation. To increase the volume of air for air separation, if necessary, stream 3 is mixed with additional air 9 and the resulting mixture, stream 20, is compressed in at least one compressor 7 to higher pressure as may be required for air separation. Additional air 9 may be compressed in at least one compressor 8 before mixing with stream 3. Other embodiments may mix at least one additional air stream 9 with stream 3 and compress stream 20 in at least one compressor 7 before air separation. Other embodiments may utilize both a compression of additional air 9 in at least one compressor 8 and a further compression of stream 20 with at least one compressor 7.

At least a portion of an oxygen rich product, or oxygen rich stream 4, is mixed with a portion of stream 10 to form mixed stream 15 and fed, at sufficient pressure, to blast furnace 2 to improve blast furnace performance. In other embodiments, oxygen rich stream 4 and feed air stream 10 are not mixed prior to being fed to blast furnace 2.

Stream 10 is typically at a pressure of about three (3) bar to about ten (10) bar. In an embodiment, stream 10 is about at a pressure of five (5) bar. Compression through at least one compressor 8 should compress additional air 9 to about the pressure of gas stream 3. Typical operating pressures for gas stream 3 and compressed additional air 9 may be about three (3) bar to about ten (10) bar. Stream 20 may be further compressed to a pressure of up to about twenty (20) bar for air separation. Compressed gas 11 may then be fed to air separation unit 1.

In the embodiment disclosed in FIG. 1, a product stream 12, such as a nitrogen product or a nitrogen rich product, is withdrawn from air separation unit 1 and heated in a heater 5. Heater 5 may be an indirect heat exchanger or a direct heat exchanger, as is common in the art. Heated product stream 13 is then expanded in hot expander 6 to allow for recovery of energy, such as energy for compression of gas stream 20 and/or stream 9 before air separation. In an embodiment, hot expander 6 and at least one compressor associated with air separation unit 1 are mechanically linked. In such a linked embodiment, as depicted in FIG. 1, expansion of stream 13 rotates a shaft that turns compressor 7 and/or compressor 8, thereby recovering energy of expansion.

Figure 2:
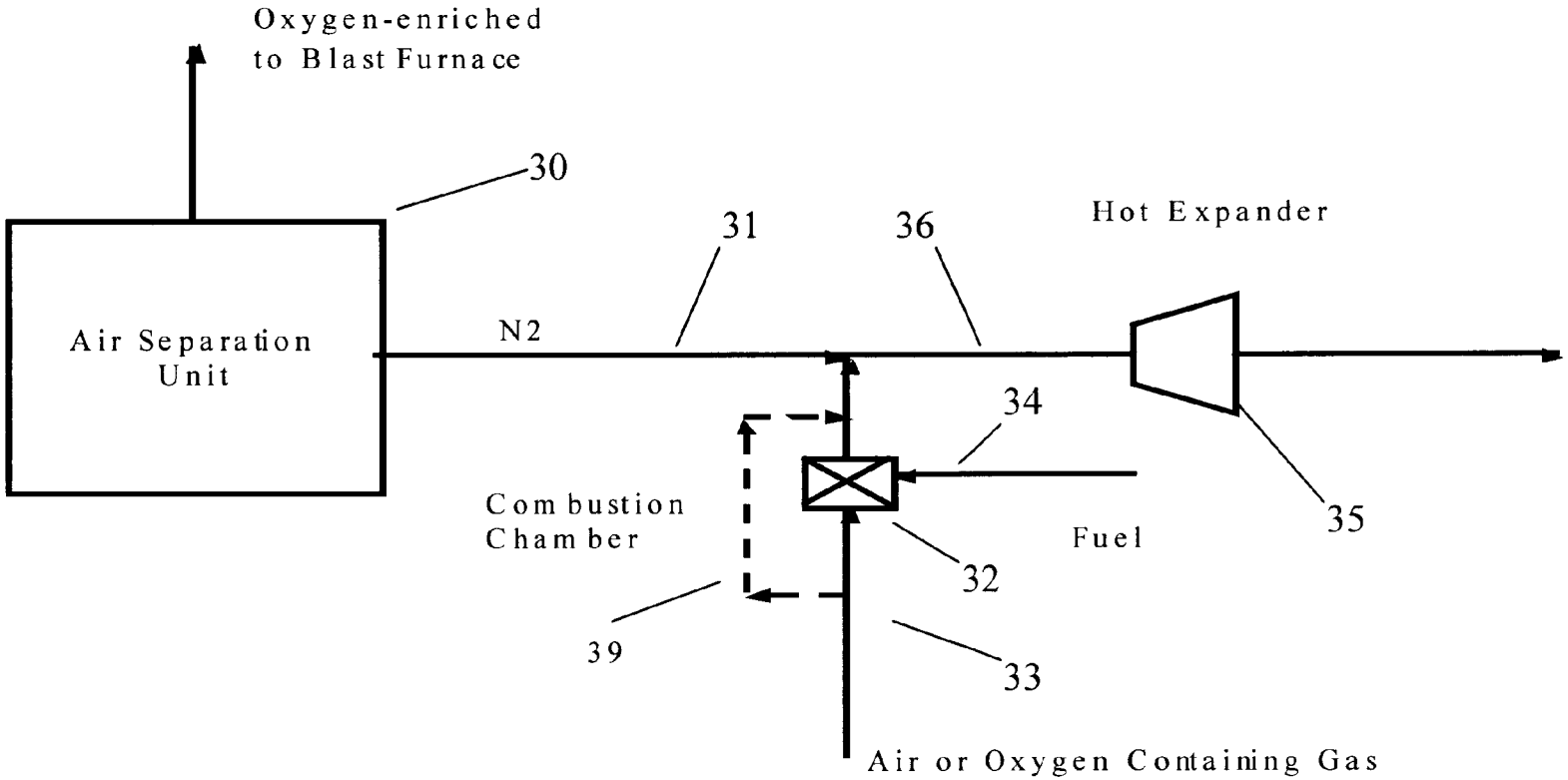
FIG. 2 is an illustration of an alternate embodiment of an integrated air separation unit with a blast furnace.

Now referring to FIG. 2, an illustration of an alternate embodiment of an integrated air separation unit with a blast furnace, a combustion chamber 32 is shown for heating, by direct heat exchange, stream 31 from air separation unit 30. A fuel 34, such as off gas 16 from blast furnace 2 (shown in FIG. 1) or other hydrocarbon, is burned in combustion chamber 32 to heat stream 31 to produce a heated product stream 36 that is hot expanded in a hot expander 35 to recover energy.

Oxygen containing stream 33 is fed to combustion chamber 32 for combustion with fuel 34. Stream 33 may be atmospheric air or any oxygen containing product, such as an oxygen rich stream. Various embodiments can include a bypass 39 to allow bypass of at least a portion of stream 33 around chamber 32.

Figure 3:
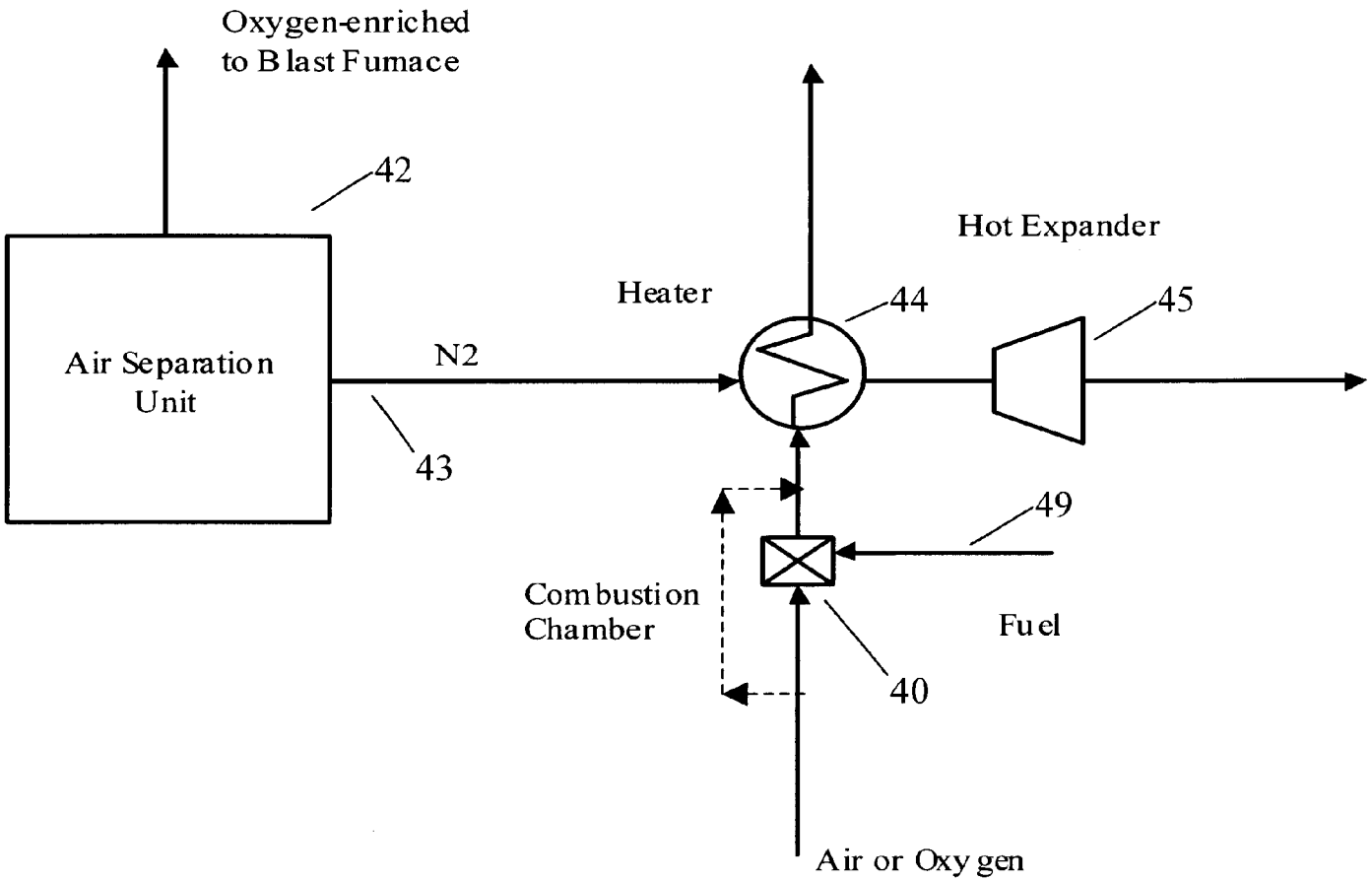
FIG. 3 is an alternate embodiment of an integrated air separation unit with a blast furnace.

Now referring to FIG. 3, an illustration of an alternate embodiment of an integrated air separation unit with a blast furnace, a low pressure combustion chamber 40 is disclosed. In embodiments of this type, fuel 49, such as off gas 16 of FIG. 1, is fed at low pressure, and does not necessarily require further compression, and combusted in chamber 40 to provide heat for heater 44. Heater 44 heats gas stream 43, by indirect heat exchange, which is then hot expanded in an expander 45 to allow for recovery of energy. In various embodiments, the exhaust gas of expander 45 can be sent to a heat recovery exchanger to preheat stream 43 to improve the fuel efficiency of the process.

The present invention also discloses a process of integrating a blast furnace and an air separation unit. Embodiments of processes of the present invention increase blast furnace production. Generally, processes of the present invention comprise the steps of feeding a gas to a blast furnace, usually air; removing at least a first portion of the feed air before feeding to the blast furnace; separating at least one oxygen rich gas and at least a second stream from the first portion in at least one air separation unit; heating the second stream; expanding the second stream to recover energy; mixing the oxygen rich stream with the blast furnace feed air; and, feeding the mixed feed gas to the blast furnace. Further embodiments include the second stream being heated by a combustion product; removing an off gas, such as a low BTU off gas from the blast furnace, and combusting the off gas in a combustion chamber; mixing another stream with the second stream before expanding the second stream; and, heating the second stream in a heat exchanger.

Although various embodiments of the present invention have been shown and described, various other modifications may be made to the present invention while keeping within the scope and content of the claims of the present invention.

We claim:

1. A process for integrating a blast furnace and an air separation unit comprising the steps of:

feeding feed air to the blast furnace;

removing a first portion of feed air to the blast furnace;

separating at least one oxygen rich stream and at least a second stream containing nitrogen from the first portion in the air separation unit;

heating the second stream containing nitrogen;

expanding the second stream containing nitrogen to recover energy; and, feed all of the oxygen rich stream to the blast furnace.

2. The process of claim 1 wherein the oxygen rich stream is mixed with feed air prior to being fed to the blast furnace.

3. The process of claim 1 wherein at least a portion of the energy recovered is utilized to drive at least one compressor associated with the air separation unit.

4. The process of claim 1 further comprising the step of removing a low BTU off gas from the blast furnace.

5. The process of claim 1 wherein the second stream is heated by indirect heat exchange.

6. The process of claim 1 wherein the second stream is heated by a combustion product from a combustion chamber.

7. The process of claim 4 wherein the second gas is heated by a combustion product of the off gas from a combustion chamber.

8. The process of claim 1 wherein the air separation unit further comprises at least one distillation column producing an oxygen rich stream having an oxygen content greater than 21.0% by volume.

9. The process of claim 1 wherein the second stream is a nitrogen rich gas.

10. The process of claim 1 wherein the feed air is at a pressure between about three (3) bar to about ten (10) bar.

11. The process of claim 1 further comprising linking the expansion of the second gas to at least one compressor associated with the air separation unit.

12. The process of claim 1 further comprising mixing additional air with the first portion.

* * * * *